US012408738B2

(12) United States Patent
Pao

(10) Patent No.: US 12,408,738 B2
(45) Date of Patent: Sep. 9, 2025

(54) FOLDING CRUTCH CHAIR WITH A FOLDING AUXILIARY POSITIONING MECHANISM

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 277 days.

(21) Appl. No.: 18/345,324

(22) Filed: Jun. 30, 2023

(65) Prior Publication Data

US 2024/0008605 A1 Jan. 11, 2024

(30) Foreign Application Priority Data

Jul. 8, 2022 (TW) ..... 111125755

(51) Int. Cl.
*A45B 5/00* (2006.01)
*A47C 9/10* (2006.01)

(52) U.S. Cl.
CPC ..... *A45B 5/00* (2013.01); *A47C 9/105* (2013.01)

(58) Field of Classification Search
CPC ..... A45B 5/00; A47C 9/10; A47C 9/105
See application file for complete search history.

(56) References Cited

U.S. PATENT DOCUMENTS

| | | | | |
|---|---|---|---|---|
| 8,876,203 | B1 * | 11/2014 | Haertl | A47C 4/04 297/29 |
| 8,997,766 | B2 * | 4/2015 | Pao | A47C 4/04 297/16.2 |
| 9,357,820 | B2 * | 6/2016 | Pao | A45B 5/00 |
| 9,414,655 | B2 * | 8/2016 | Pao | A45B 5/00 |
| 9,504,297 | B2 * | 11/2016 | Pao | A47C 4/04 |
| 9,681,713 | B2 * | 6/2017 | Pao | A45B 5/00 |
| 10,064,462 | B2 * | 9/2018 | Pao | A45B 5/00 |
| 11,432,651 | B2 * | 9/2022 | Pao | A45B 5/00 |
| 11,700,946 | B2 * | 7/2023 | Pao | A47C 9/105 297/16.2 |
| 2014/0034097 | A1 * | 2/2014 | Pao | A45B 5/00 135/66 |

(Continued)

FOREIGN PATENT DOCUMENTS

| | | | |
|---|---|---|---|
| CN | 113142766 | A * | 7/2021 |
| CN | 113995210 | A * | 2/2022 |

(Continued)

*Primary Examiner* — David R Dunn
*Assistant Examiner* — Danielle Jackson
(74) *Attorney, Agent, or Firm* — Burris Law, PLLC

(57) ABSTRACT

A folding crutch chair includes a pivot base unit, a primary leg unit, at least two support leg units, a positioning unit and a seating unit. The leg units are mounted on the pivot base unit. The positioning unit is mounted on the primary leg unit, and has a mounting seat and a positioning member. The positioning member has a guiding slope surface. A seating member of the seating unit is shiftable between a collapsed position and a seated position. During the operation from the seated position to the collapsed position, the seating member is actuated to move the guiding slope surface to generate a retention force for keeping the seating member unmoved relative to the positioning member so as to facilitate the folding operation.

10 Claims, 12 Drawing Sheets

(56) References Cited

U.S. PATENT DOCUMENTS

| | | | | |
|---|---|---|---|---|
| 2015/0107636 | A1* | 4/2015 | Pao | A45B 5/00 135/66 |
| 2015/0196103 | A1* | 7/2015 | Pao | A47C 9/105 297/55 |
| 2024/0041217 | A1* | 2/2024 | Pao | A47C 9/105 |
| 2025/0143471 | A1* | 5/2025 | Pao | A47C 9/10 |
| 2025/0146524 | A1* | 5/2025 | Pao | F16C 11/04 |

FOREIGN PATENT DOCUMENTS

| | | | | | |
|---|---|---|---|---|---|
| CN | 114903262 | A | * | 8/2022 | A45B 5/00 |
| CN | 115721084 | A | * | 3/2023 | |
| CN | 119279322 | A | * | 1/2025 | |
| TW | I480038 | | | 4/2015 | |

* cited by examiner

FOLDING CRUTCH CHAIR WITH A FOLDING AUXILIARY POSITIONING MECHANISM

CROSS-REFERENCE TO RELATED APPLICATION

This application claims priority to Taiwanese Patent Application No. 111125755, filed on Jul. 8, 2022.

FIELD

The disclosure relates to a folding crutch chair, and more particularly to a folding crutch chair with a folding auxiliary positioning mechanism.

BACKGROUND

A conventional folding crutch chair as disclosed in TWI480038 includes a primary leg, a seating unit, a lower retaining unit, a support unit and a linkage unit. The seating unit has an upper slider slidable along the primary leg, and a seating member pivotably connected with the upper slider. When the upper slider is operated to slide along the primary leg, the support unit is shifted from a folded state to an unfolded state through the movement of the linkage unit and the support unit with the seating unit. A seating surface of the seating member is kept transverse to the primary leg to be seated thereon. However, during the shifting of the support unit from the unfolded state to the folded state through the sliding movement of the upper slider along the primary leg, due to the weight of the seating unit which tends to move downwardly, a user is required to hold the primary leg with one hand, and press the seating unit toward the primary leg with the other hand. The operation of the conventional folding crutch chair is quite troublesome, especially for the elderly.

SUMMARY

Therefore, an object of the disclosure is to provide a folding crutch chair that can alleviate at least one of the drawbacks of the prior art.

According to the disclosure, the folding crutch chair includes a pivot base unit, a primary leg unit, at least two support leg units, a positioning unit and a seating unit. The primary leg unit and the support leg units are mounted on the pivot base unit. Each of the primary leg unit and the support leg units has a lower end portion. The primary leg unit and the support leg units are shiftable between a folded state, where the lower end portions are close to one another, and an unfolded state, where the lower end portions are remote from one another. The positioning unit is mounted on the primary leg unit. The positioning unit has a mounting seat which is secured on the primary leg unit, and a positioning member which is movably mounted on the mounting seat. The mounting seat has a lower end and an upper end which are opposite to each other along a longitudinal direction of the primary leg unit. The positioning member has a guiding slope surface which extends from one end proximal to the lower end to the other end proximal to the upper end and is gradually inclined away from the mounting seat. The guiding slope surface is actuated to be moved relative to the mounting seat and is biased to return back to its original position. The seating unit has a sliding bracket which is slidably sleeved on the primary leg unit, and a seating member which is connected with the sliding bracket and supported by the support leg units. The seating member has a seating surface, and is shiftable between a collapsed position, where the seating surface of the seating member is close to and extends parallel to the primary leg unit when the primary leg unit and the support leg units are in the folded state, and a seated position, where the seating surface is remote from and extends transverse to the primary leg unit when the primary leg unit and the support leg units are in the unfolded state. The seating member makes a sliding movement along the guiding slope surface, during shifting of the seating member from the seated position to the collapsed position, to actuate and move the guiding slope surface relative to the mounting seat so as to generate a retention force for keeping the seating member unmoved relative to the positioning member.

With the positioning unit, during the operation of the seating member from the seated position to the collapsed position, the seating member is moved, through the guiding of the guiding slope surface, to press the positioning member and to bring the positioning member to retain the seating unit so as to facilitate the operation for folding the folding crutch chair.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
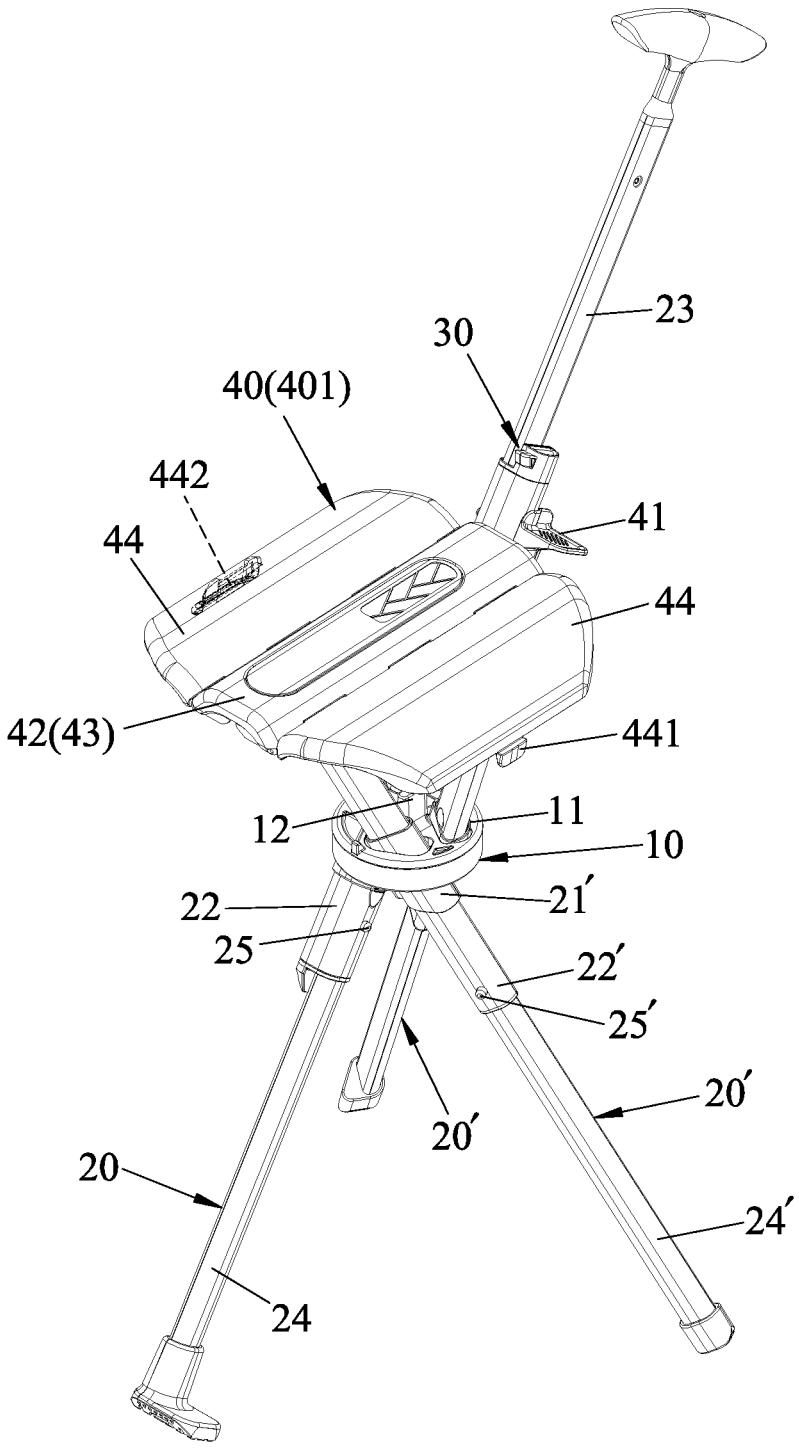
FIG. 1 is a perspective view illustrating an embodiment of a folding crutch chair according to the disclosure in an unfolded state.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
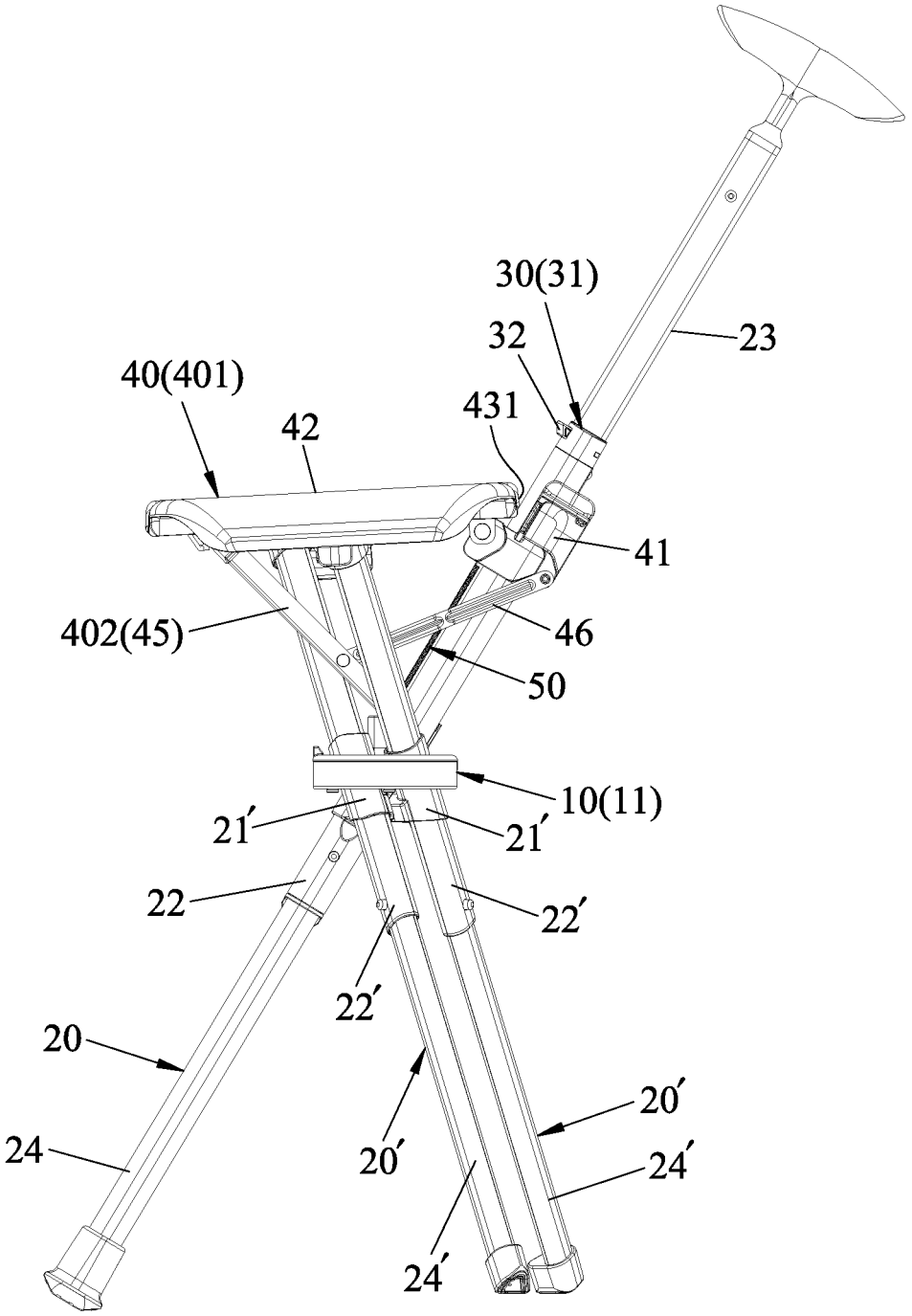
FIG. 2 is a side view of the embodiment in the unfolded state.
Figure 3:
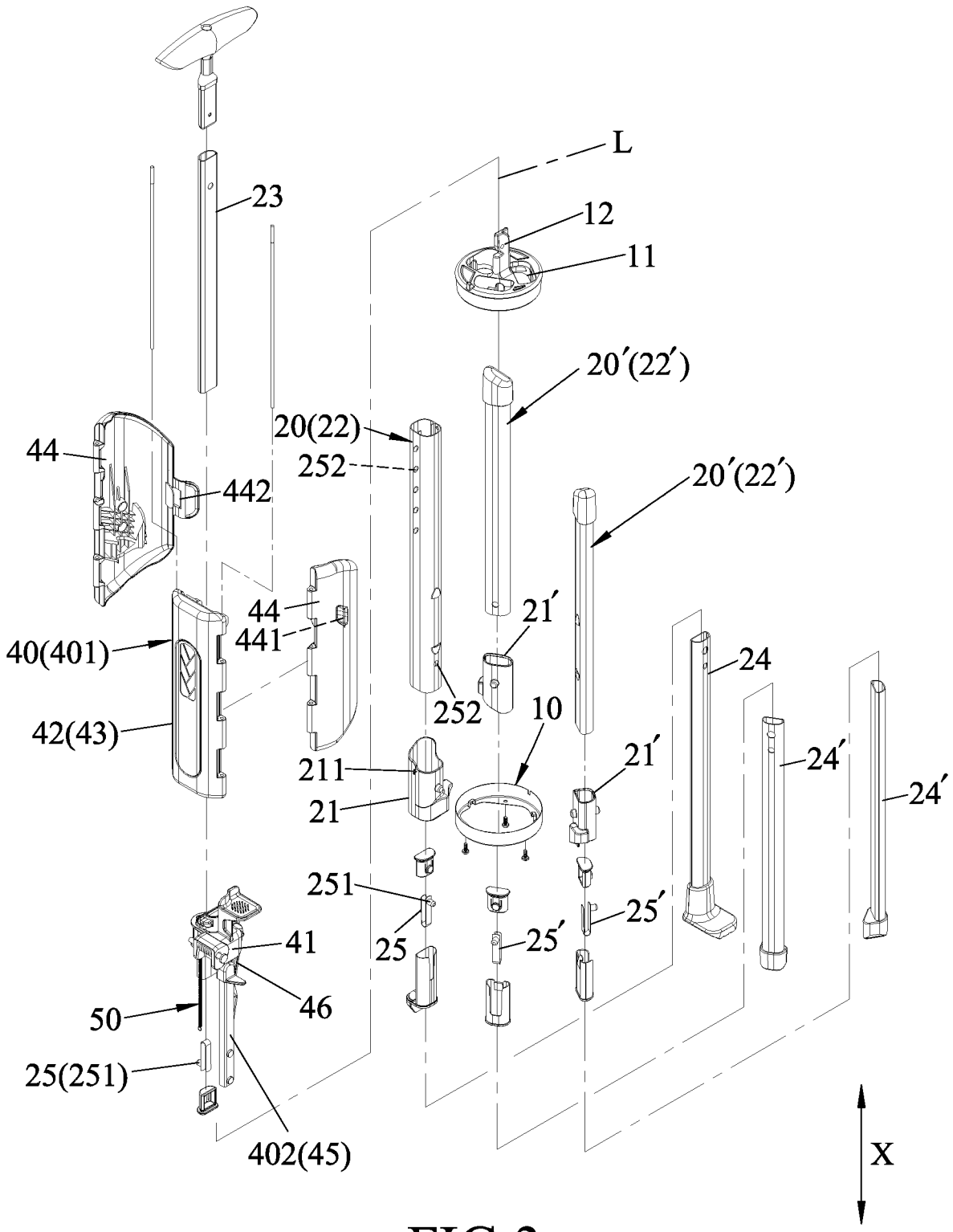
FIG. 3 is an exploded perspective view of the embodiment.
Figure 4:
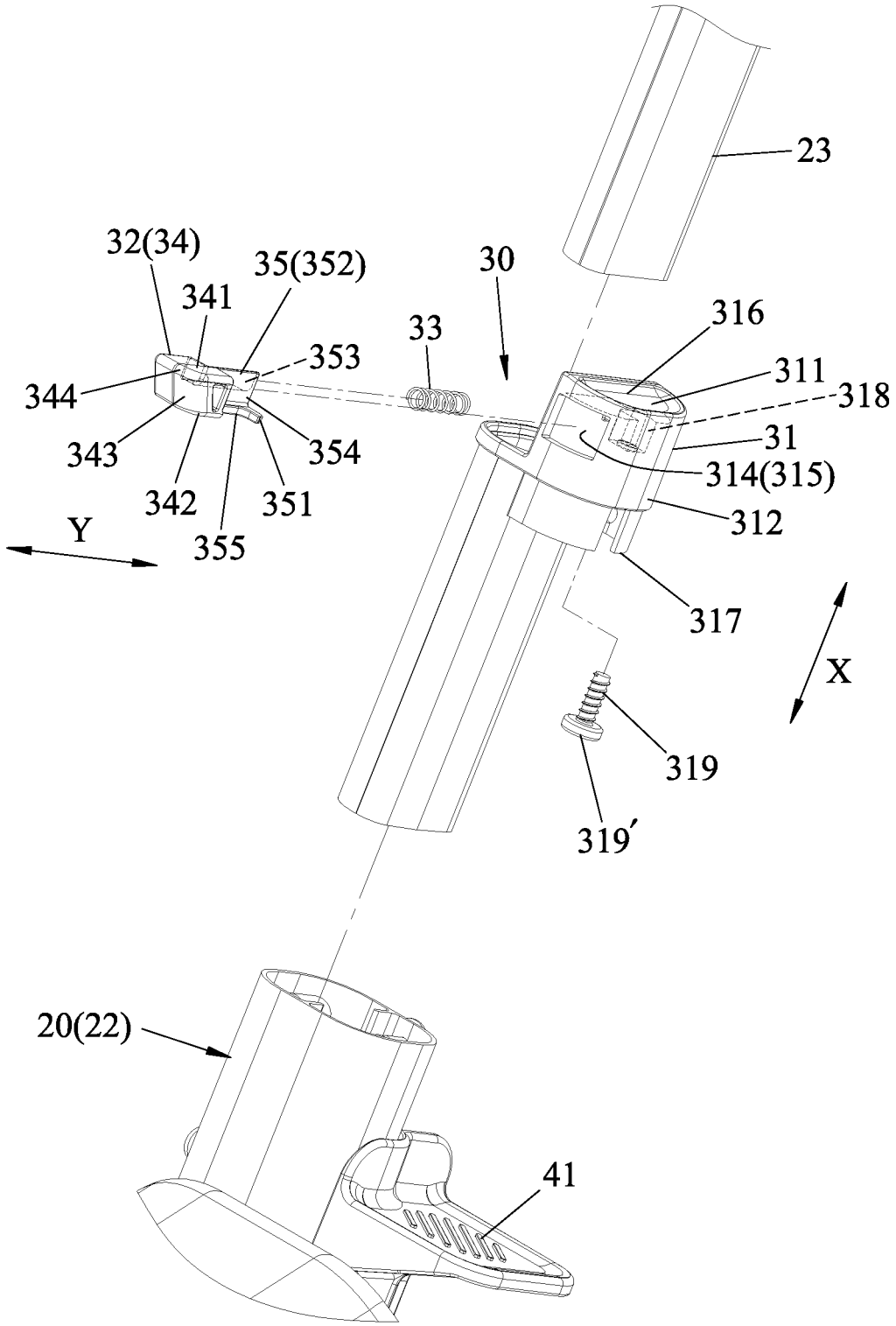
FIG. 4 is a fragmentary, exploded perspective view illustrating a positioning unit of the embodiment.
Figure 5:
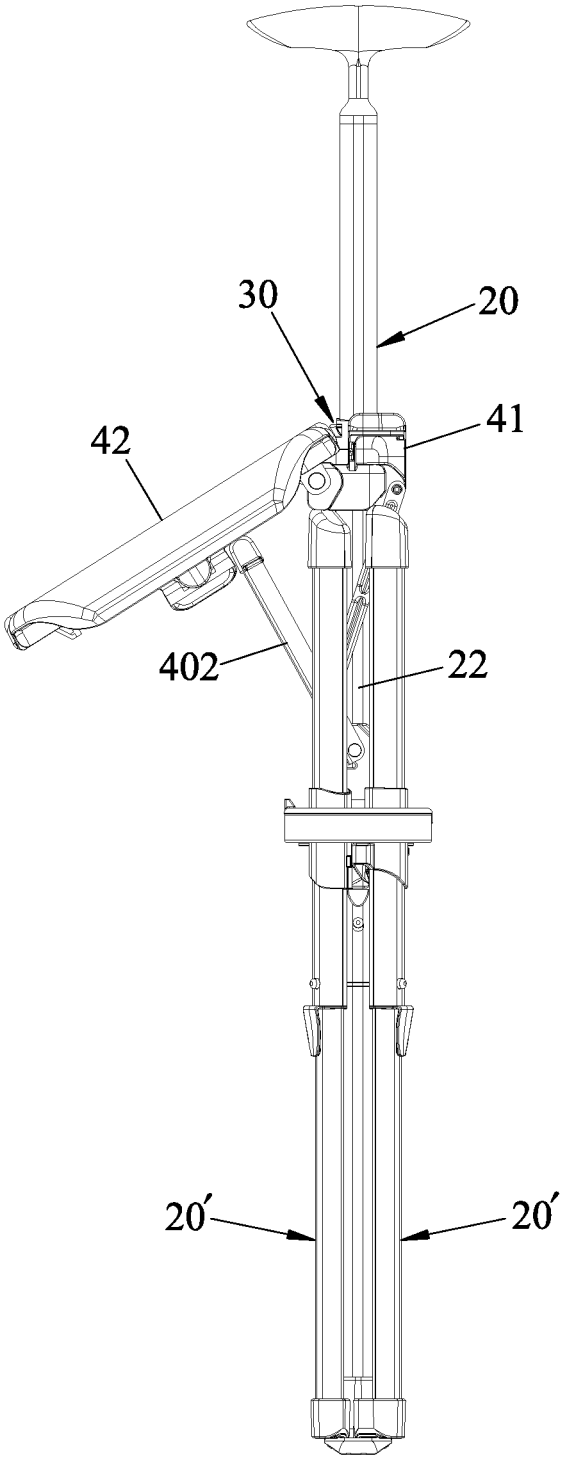
FIG. 5 is a side view illustrating the embodiment during the shifting to a folded state.

Referring to FIGS. 1, 2 and 3, an embodiment of a folding crutch chair according to the disclosure includes a pivot base unit 10, a primary leg unit 20, two support leg units (20'), a positioning unit 30, a seating unit 40 and a tension spring 50.

The pivot base unit 10 has a plurality of mounting slots 11 which are angularly spaced apart from one another about an axial line (L) in a longitudinal direction (X), and a pivot post 12 which extends along the axial line (L).

The primary leg unit 20 has a pivot seat 21 which is mounted in one of the mounting slots 11 and pivotably connected with the pivot base unit 10, an outer tubular piece 22 which is securely disposed on the pivot seat 21 and which extends along the longitudinal direction (X), an upper tubular piece 23 which extends telescopically relative to the outer tubular piece 22 along the longitudinal direction (X), an inner tubular piece 24 which extends telescopically relative to the outer tubular piece 22 along the longitudinal direction (X), and two retaining assemblies 25 which are respectively connected between the outer tubular piece 22 and the upper tubular piece 23, and between the outer tubular piece 22 and the inner tubular piece 24. The pivot seat 21 has a spring hook 211. The upper tubular piece 23 and the inner tubular piece 24 of the primary leg unit 20 are opposite to each other in a second transverse direction that is transverse to the longitudinal direction (X). The retaining assemblies 25 are respectively disposed on a lower portion of the upper tubular piece 23 and an upper portion of the inner tubular piece 24. Each retaining assembly 25 has a spring-biased pin 251 which extends radially to be engaged in a selected one of pin holes 252 formed in the outer tubular piece 22 so as to retain the upper and inner tubular pieces 23, 24 to the outer tubular piece 22.

Each of the two support leg units (20') also has a pivot seat (21') which is mounted in a corresponding one of the mounting slots 11, an outer tubular piece (22') which is securely disposed on the pivot seat (21') and which extends along the longitudinal direction (X), an inner tubular piece (24') which extends telescopically relative to the outer tubular piece (22') along the longitudinal direction (X), and a retaining assembly (25') which is connected between the outer tubular piece (22') and the inner tubular piece (24'). The pivot seat (21'), the outer tubular piece (22'), the inner tubular piece (24') and the retaining assembly (25') are similar to those of the primary leg unit 10.

With reference to FIGS. 4, 5, 6 and 7, the positioning unit 30 is mounted on the primary leg unit 20, and has a mounting seat 31 which is secured on an upper end of the outer tubular piece 22, a positioning member 32 which is slidably mounted on the mounting seat 31, and a biasing member 33 which is connected between the mounting seat 31 and the positioning member 32. The mounting seat 31 has an upper wall 311 which serves as an upper end 316, a peripheral wall 312 which extends downwardly from a periphery of the upper wall 311 to cooperatively define a mounting space 315, a tubular wall 318 which extends downwardly from the upper wall 311 and in the mounting space 315, and a screw 319 which is threadedly engaged with the tubular wall 318 and which extends in the longitudinal direction (X), and has a head (319') that is spaced apart from the tubular wall 318. The peripheral wall 312 has a lower end 317 opposite to the upper end 316 along the longitudinal direction (X), and a sliding slot 314 which extends therethrough in a first transverse direction (Y) that is transverse to the longitudinal direction (X) to communicate with the mounting space 315.

The positioning member 32 extends in the first transverse direction (Y) and is slidably mounted on the mounting seat 31 in the sliding slot 314 and guided by the tubular wall 318 to be inserted into the mounting space 315. Specifically, the positioning member 32 has a positioning section 34 and a sliding section 35 which extends from the positioning section 34 in the first transverse direction (Y). The positioning section 34 has an upper wall surface 341, a lower wall surface 342 opposite to the upper wall surface 341, a guiding slope surface 343 which extends from the lower wall surface 342 toward the upper wall surface 341, and an acute angle portion 344 which is formed at a juncture between the upper wall surface 341 and the guiding slope surface 343. The guiding slope surface 343 is gradually inclined away from the mounting seat 31. The sliding section 35 has a bottom plate 351 and an upright plate 352 which extends upwardly from the bottom plate 351 and which cooperates with the bottom plate 351 to define a first lateral slot 353 at one side of the upright plate 352 and a second lateral slot 354 at the other side of the upright plate 352. The bottom plate 351 has a notch 355 which extends therethrough in the longitudinal direction (X) and which is aligned with the second lateral slot 354. The screw 319 extends through the notch 355 to have the tubular wall 318 and the head (319') be at two opposite sides of the bottom plate 351, respectively. The biasing member 33 is disposed in the first lateral slot 353 to bias the guiding slope surface 343 away from the mounting seat 31.

Figure 6:
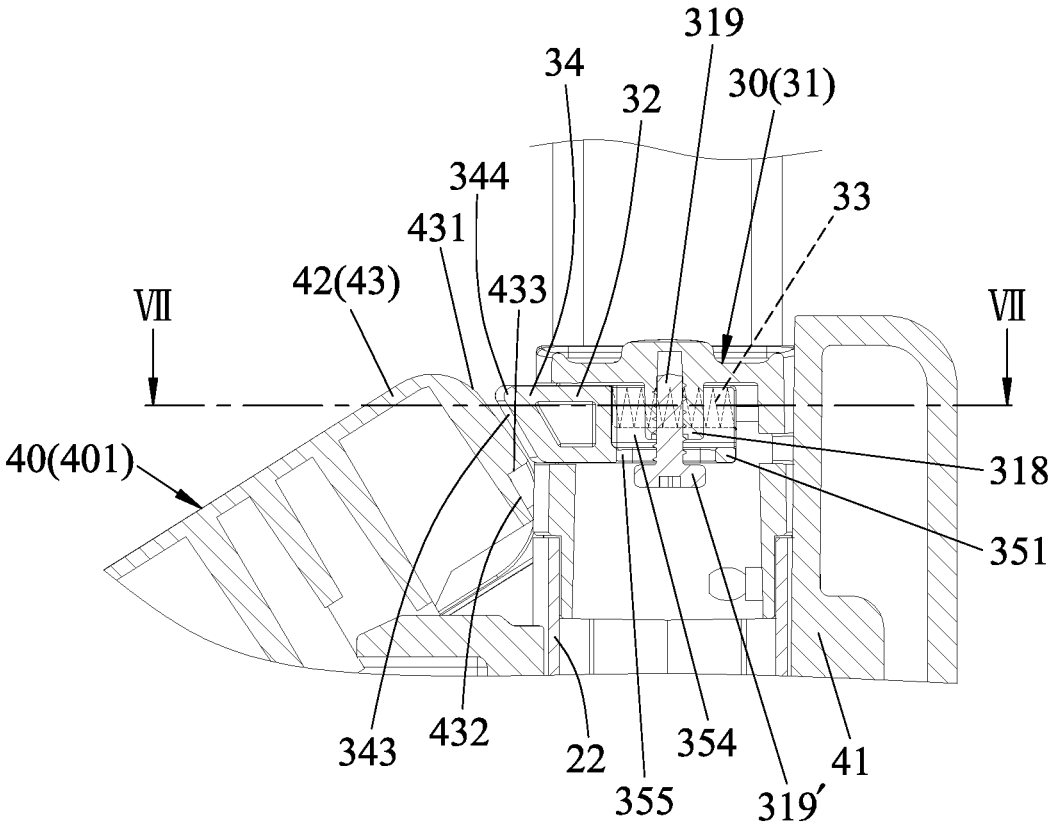
FIG. 6 is a fragmentary, enlarged sectional view illustrating a portion of FIG. 5.
Figure 7:
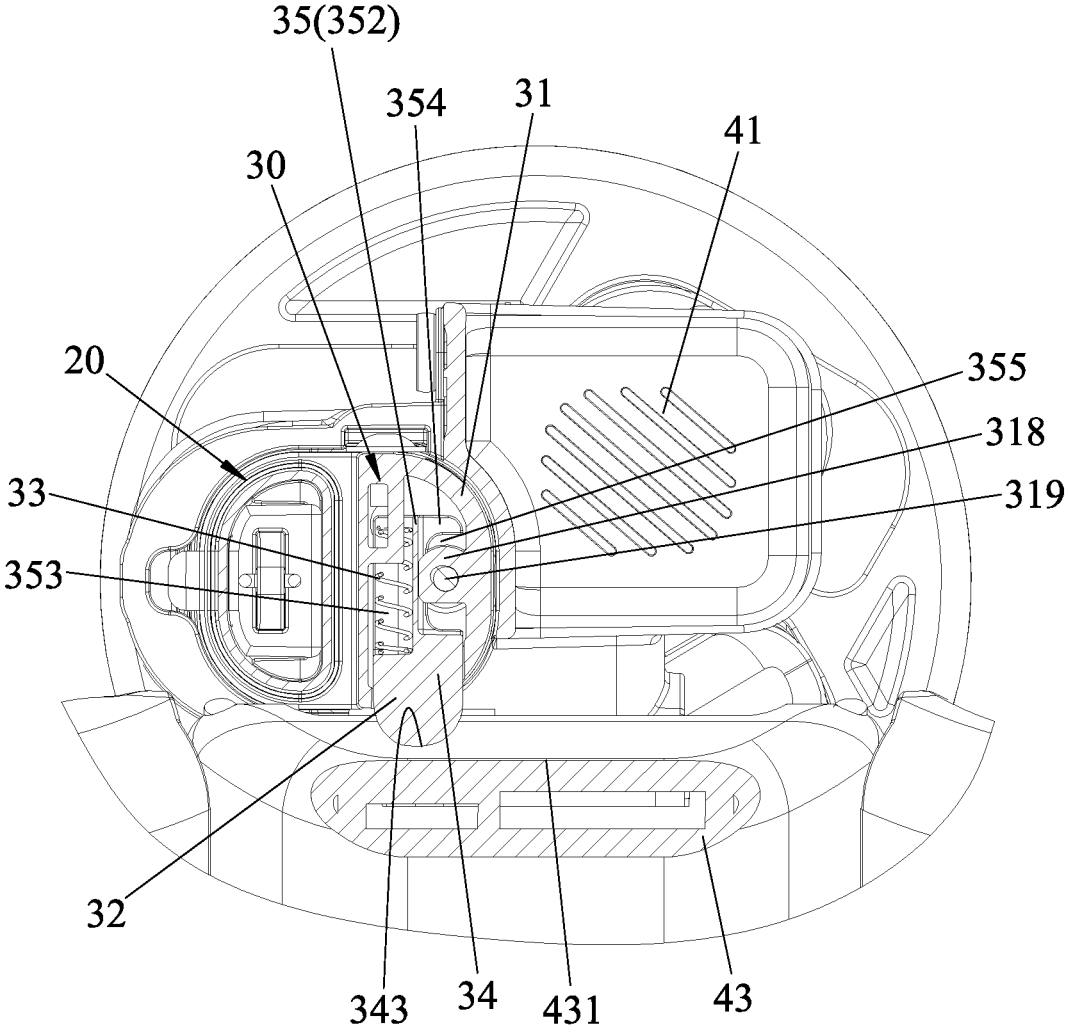
FIG. 7 is a sectional view taken along line VII-VII of FIG. 6.

The seating unit 40 includes a seating assembly 401 which is connected with an upper portion of the outer tubular piece 22 of the primary leg unit 20, and a linkage assembly 402 which is pivotally connected with the pivot post 12 and moved with the seating assembly 401. The seating unit 40 has a sliding bracket 41 which is slidably sleeved on the outer tubular piece 22 of the primary leg unit 20, and a seating member 42 which is pivotably connected with the sliding bracket 41 and supported by the support leg units (20'). Specifically, the seating member 42 has a central plate portion 43 which is pivotably connected with the sliding bracket 41, and a pair of lateral plate portions 44 which are adjoined with the central plate portion 43 and respectively supported by the support leg units (20'). The distal end edges of the lateral plate portions 44 respectively have male and female fasteners 441, 442 to be snap connected with each other. Referring to FIG. 6, the central plate portion 43 has a rim wall 431 which is disposed adjacent to the sliding bracket 41 and faces the guiding slope surface 343, a recessed portion 432 which is recessed from the rim wall 431, and a shoulder 433 which is formed between the recessed portion 432 and the rim wall 431. The linkage assembly 402 has a first linking bar 45 which is pivotably connected with the pivot post 12 at one end and which is slidable on a bottom surface of the central plate portion 43 at an opposite end, and a second linking bar 46 which is pivotably connected between the first linking bar 45 and the sliding bracket 41.

The tension spring 50 has an upper end connected with the sliding bracket 41, and an opposite lower end connected with the spring hook 211 of the pivot seat 21 of the primary leg unit 20 to bias the sliding bracket 41 toward the pivot base unit 10. Alternatively, the lower end of the tension spring 50 may be connected with the pivot base unit 10.

Referring again to FIGS. 1 and 2, when the primary leg unit 20 and the support leg units (20') are in an unfolded state, the seating member 42 is spreaded in a seated position, where a seating surface thereof which is opposite to the bottom surface of the central plate portion 43 is remote from and extends transverse to the primary leg unit 20. In this state, lower end portions of the primary leg unit 20 and the support leg units (20') are remote from one another, upper end portions of the support leg units (20') are remote from each other and are engaged with the lateral plate portions 44 to support the lateral plate portions 44, the first linking bar 45 supports the central plate portion 43, and a proximal end of the central plate portion 43 adjacent to the rim wall 431 is pivotably connected with the sliding bracket 41.

Figure 9:
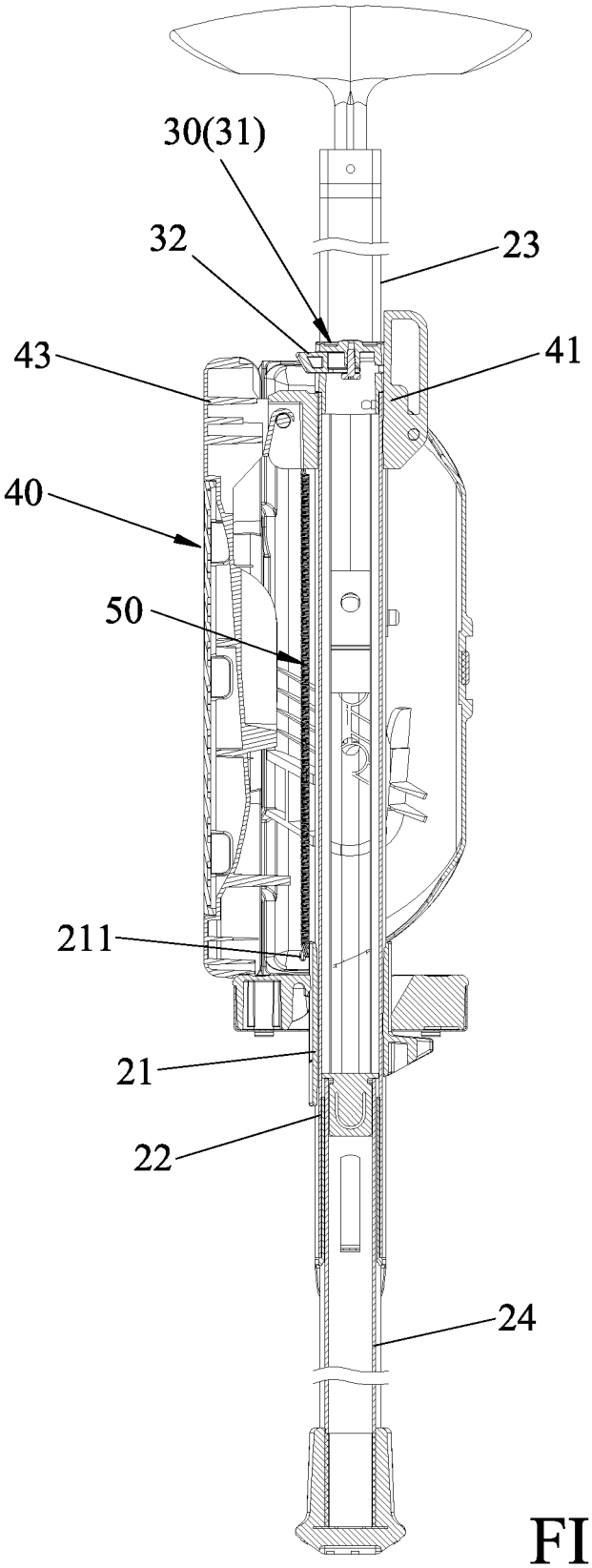
FIG. 9 is a fragmentary sectional view illustrating the embodiment in the folded state.
Figure 10:
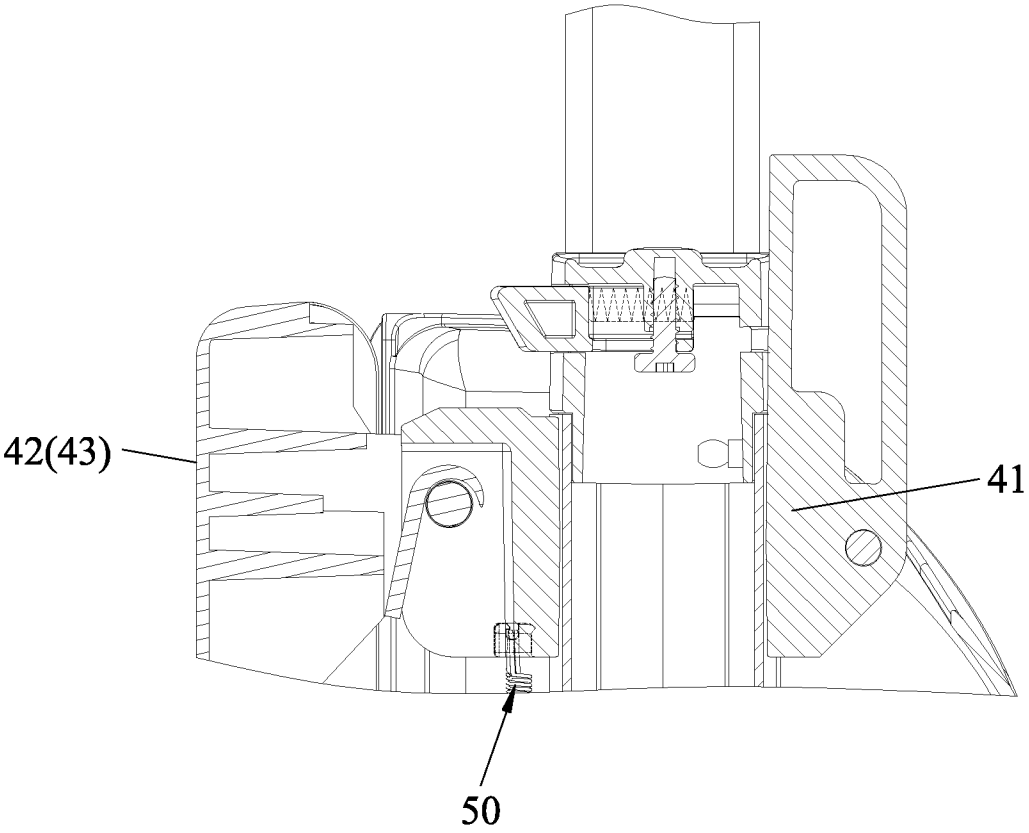
FIG. 10 is a fragmentary, enlarged sectional view illustrating a portion of FIG. 9.

Referring again to FIGS. 5 and 6, when a user operates the sliding bracket 41 to move it upwardly along the outer tubular piece 22, through the movement of the linkage assembly 402 with the sliding bracket 41, the seating member 42 is moved with the linkage assembly 402 and shifted to a collapsed position (as shown in FIG. 9), where the seating surface of the seating member 42 is close to and extends parallel to the primary leg unit 20. At this time, the primary leg unit 20 which is connected with the linkage assembly 402 is pivoted relative to the pivot base unit 10, and the primary leg unit 20 and the support leg units (20') are shifted from the unfolded state (see FIGS. 1 and 2) to a folded state (see FIG. 9), where the lower end portions of the primary leg unit 20 and the support leg units (20') are close to one another. The seating member 42 is close to the sliding bracket 41 (as shown in FIG. 10) in the collapsed position. At this stage, the sliding bracket 41 is moved away from the pivot seat 21 so that the tension spring 50 is tensed.

Figure 8:
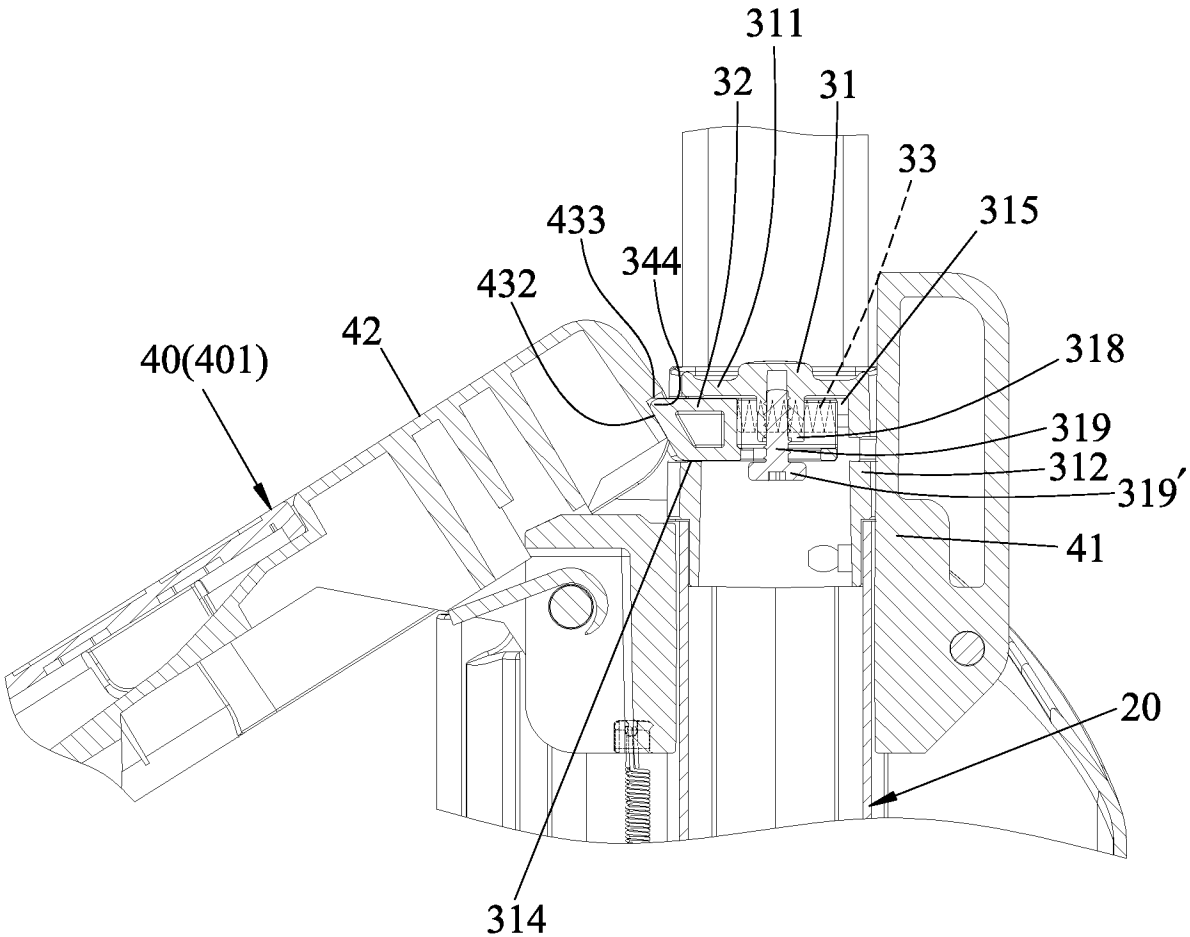
FIG. 8 is a view similar to FIG. 6, illustrating a state where a seating unit is retained by the positioning unit during the folding.

Referring again to FIGS. 5 and 6, during the upward sliding of the sliding bracket 41 and when the sliding bracket 41 approaches the positioning unit 30, the seating member 42 is inclined relative to the primary leg unit 20, and the rim wall 431 is brought to abut against and to move along the guiding slope surface 343 so as to move the positioning member 32 in the first transverse direction (Y) toward the inside of the mounting seat 31 against a biasing action of the biasing member 33. With reference to FIG. 8, an upward sliding movement of the seating member 42 along the guiding slope surface 343 results in engagement of the recessed portion 432 with the positioning member 32. With the biasing action of the biasing member 33, the positioning member 32 is biased to move outwardly to bring the acute portion 344 to be inserted into the recessed portion 432 and to be retainingly abutted against the shoulder 433. At this stage, a retention force is generated to keep the seating member 42 unmoved relative to the positioning member 32 so that the seating assembly 401 may be positioned relative to the primary leg unit 20 without the need to hold the sliding bracket 41 or the seating member 42. Finally, the user presses the distal end edges of the lateral plate portions 44 close to each other relative to the primary leg unit 20 to fold the seating member 42, as shown in FIG. 9.

Figure 11:
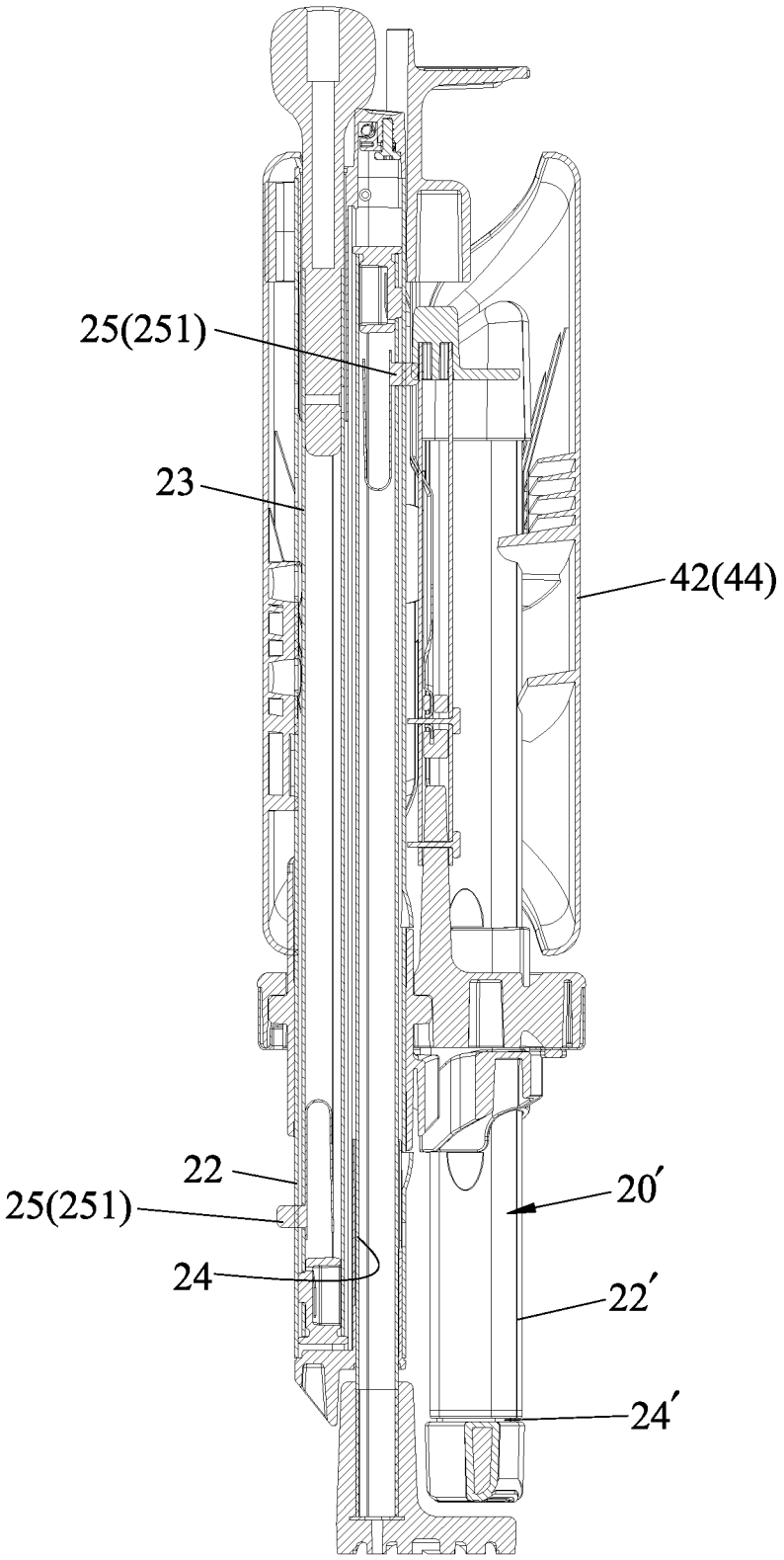
FIG. 11 is a sectional view illustrating the embodiment in a fully folded state.
Figure 12:
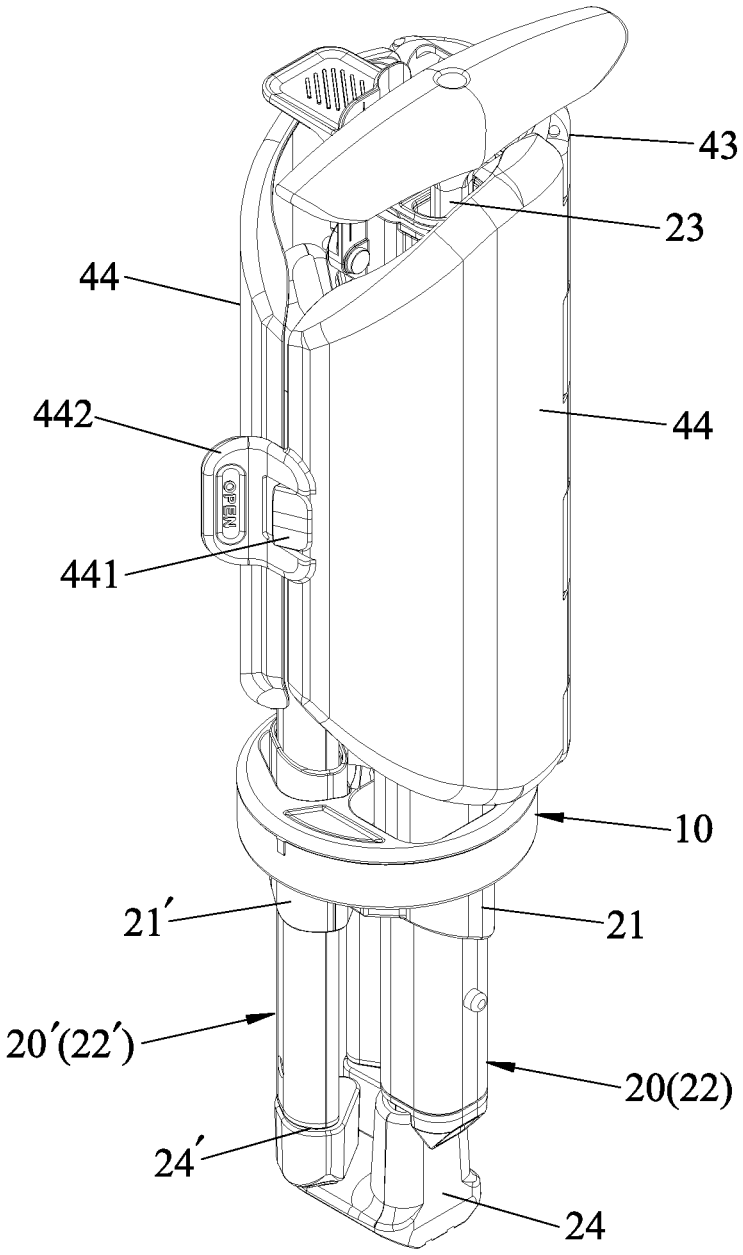
FIG. 12 is a perspective view of the embodiment in the fully folded state.

Next, the upper tubular piece 23 of the primary leg unit 20 is retracted into the outer tubular piece 22, and the inner tubular piece 24 is retracted into the outer tubular piece 22. The upper and inner tubular pieces 23, 24 are retained to the outer tubular piece 22 by the retaining assemblies 25. Also, the inner tubular piece (24') of each support leg unit (20') is retracted into the outer tubular piece (22') and is retained to the outer tubular piece (22') by the retaining assembly, as shown in FIG. 11, so as to render the folding crutch chair compact. When the primary leg unit 20 and the support leg units (20') are in the folded state, the seating member 42 is in the collapsed position, the lateral plate portions 44 and the central plate portion 43 cooperatively define a hollow cylinder (see FIG. 12) to surround the primary leg unit 20 and the support leg units (20'). Then, the male and female fasteners 441, 442 of the lateral plate portions 44 are snap connected with each other.

When the user operates the sliding bracket 41 to move it downwardly along the primary leg unit 20, the sliding bracket 41 is moved smoothly toward the pivot base unit 10 with the biasing action of the tension spring 50. Through the transmitting movement of the second linking bar 46 and the first linking bar 45 of the linkage assembly 402, the primary leg unit 20 is pivoted relative to the pivot base unit 10, and the support leg units (20') are pivoted to have the lower end portions of the leg units be remote from one another so as to be in a support state.

It is noted that the biasing member of the positioning unit 30 may be dispensed with. The positioning member 32 may be made of an elastomeric material with a biasing force generated when the guiding slope surface 343 is actuated to be moved relative to the mounting seat 31, which urges the positioning member 32 to return back to its original position.

Moreover, in this embodiment, the primary leg unit 20 and the support leg units (20') are pivotably mounted on the pivot base unit 10. Alternatively, for example, they may have the structure disclosed in U.S. Pat. No. 8,997,766 which the positioning unit 30 may also be employed on.

As illustrated, during the folding of the folding crutch chair, the seating member 42 is retained to the positioning member 32, which is convenient for the elderly to operate. Additionally, the construction of the folding crutch chair is simple and is easy to fabricate.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A folding crutch chair comprising:

a pivot base unit;

a primary leg unit and at least two support leg units mounted on said pivot base unit, each of said primary leg unit and said support leg units having a lower end portion, said primary leg unit and said support leg units being shiftable between a folded state, where said lower end portions are close to one another, and an unfolded state, where said lower end portions are remote from one another;

a positioning unit mounted on said primary leg unit, said positioning unit having a mounting seat which is secured on said primary leg unit, and a positioning member which is movably mounted on said mounting seat, said mounting seat having a lower end and an upper end which are opposite to each other along a longitudinal direction of said primary leg unit, said positioning member having a guiding slope surface which extends from one end proximal to said lower end to the other end proximal to said upper end and is gradually inclined away from said mounting seat, said guiding slope surface being actuated to be moved relative to said mounting seat and being biased to return back to its original position; and a seating unit having a sliding bracket which is slidably sleeved on said primary leg unit, and a seating member which is connected with said sliding bracket and supported by said support leg units, said seating member having a seating surface, and being shiftable between a collapsed position, where said seating surface of said seating member is close to and extends parallel to said primary leg unit when said primary leg unit and said support leg units are in the folded state, and a seated position, where said seating surface is remote from and extends transverse to said primary leg unit when said primary leg unit and said support leg units are in the unfolded state, wherein, said seating member makes a sliding movement along said guiding slope surface, during shifting of said seating member from the seated position to the collapsed position, to actuate and move said guiding slope surface relative to said mounting seat so as to generate a retention force for keeping said seating member unmoved relative to said positioning member.

2. The folding crutch chair of claim 1, wherein said positioning member is slidably mounted on said mounting seat in a first transverse direction that is transverse to the longitudinal direction, said positioning unit having a biasing member which is connected between said mounting seat and said positioning member to bias said guiding slope surface away from said mounting seat in the first transverse direction.

3. The folding crutch chair of claim 2, wherein said seating member has a rim wall which is disposed adjacent to said sliding bracket and faces said guiding slope surface, a recessed portion which is recessed from said rim wall, and a shoulder which is formed between said recessed portion and said rim wall, said positioning member having an upper wall surface, a lower wall surface opposite to said upper wall surface, and an acute angle portion which is formed at a juncture between said upper wall surface and said guiding slope surface, said seating member being moved with a sliding movement of said sliding bracket to bring said rim wall to abut against and to move along said guiding slope surface, and to move said positioning member in the first transverse direction against a biasing action of said biasing member which urges said positioning member away from said mounting seat to permit said acute angle portion to be inserted into said recessed portion.

4. The folding crutch chair of claim 3, wherein each of said primary leg unit and said support leg units has an outer tubular piece which is pivotably mounted on said pivot base unit and which extends along the longitudinal direction, an inner tubular piece which extends telescopically relative to said outer tubular piece along the longitudinal direction, and a retaining assembly which is connected between said outer tubular piece and said inner tubular piece, said mounting seat being securely disposed on an top portion of said outer tubular piece of said primary leg unit.

5. The folding crutch chair of claim 4, wherein said mounting seat has an upper wall which serves as said upper end, a peripheral wall which extends downwardly from a periphery of said upper wall to cooperatively define a mounting space, and a tubular wall which extends downwardly from said upper wall and in said mounting space, said peripheral wall having a sliding slot which extends therethrough in the first transverse direction to communicate with said mounting space, said positioning member extending in the first transverse direction, and being slidable along said sliding slot and guided by said tubular wall to be inserted into said mounting space.

6. The folding crutch chair of claim 5, wherein said mounting seat has a screw which is threadedly engaged with said tubular wall and which extends in the longitudinal direction, said screw having a head which is spaced apart from said tubular wall, said positioning member having a positioning section and a sliding section which extends from said positioning section in the first transverse direction, said upper wall surface, said lower wall surface, said guiding slope surface and said acute angle portion being formed on said positioning section, said sliding section having a bottom plate and an upright plate which extends upwardly from said bottom plate and which cooperates with said bottom plate to define a first lateral slot at one side of said upright plate and a second lateral slot at the other side of said upright plate, said bottom plate having a notch which extends therethrough in the longitudinal direction and which is aligned with said second lateral slot, said biasing member being disposed in said first lateral slot, said screw extending through said notch to have said tubular wall and said head be at two opposite sides of said bottom plate, respectively.

7. The folding crutch chair of claim 4, wherein said primary leg unit further has an upper tubular piece which extends telescopically relative to said outer tubular piece along the longitudinal direction, said upper tubular piece and said inner tubular piece of said primary leg unit being opposite to each other in a second transverse direction that is transverse to the longitudinal direction.

8. The folding crutch chair of claim 1, wherein said seating unit includes a seating assembly which is connected with said primary leg unit and which has said sliding bracket and said seating member, and a linkage assembly which is pivotally connected between said sliding bracket and said pivot base unit and which is moved with said seating assembly, wherein, through the movement of said linkage assembly with said seating assembly, said primary leg unit is pivoted relative to said pivot base unit, and said primary leg unit and said support leg units are shifted between the folded state and the unfolded state, and wherein, through the pivoting of said primary leg unit relative to said pivot base unit generated as a result of the movement of said linkage assembly, said primary leg unit and said support leg units are shifted from the folded state to the unfolded state, and said seating member is shifted from the collapsed position, where said seating surface of said seating member is close to said pivot base unit, to the seated position, where said seating surface is remote from said pivot base unit.

9. The folding crutch chair of claim 8, further comprising a tension spring which has an end connected with said sliding bracket, and an opposite end connected with one of said pivot base unit and said primary leg unit to bias said sliding bracket toward said pivot base unit.

10. The folding crutch chair of claim 1, wherein said pivot base unit has at least three mounting slots which are angularly spaced apart from one another about an axial line, said primary leg unit and said support leg units respectively extending through said mounting slots and being pivotably disposed on said pivot base unit.

* * * * *